United States Patent [19]

Chumbley et al.

[11] 4,397,346

[45] Aug. 9, 1983

[54] INSULATED WINDOW SHADE

[75] Inventors: James F. Chumbley; Michael W. Corke, both of King County; Jo Yount, Jefferson County, all of Wash.

[73] Assignee: Warm Window, Inc., Seattle, Wash.

[21] Appl. No.: 268,722

[22] Filed: Jun. 1, 1981

[51] Int. Cl.[3] ..... E06B 3/94

[52] U.S. Cl. ..... 160/84 R; 160/DIG. 7

[58] Field of Search ..... 160/DIG. 7, 123, 268, 160/84 R; 428/182, 241, 236, 286, 300, 458

[56] References Cited

U.S. PATENT DOCUMENTS

| | | | |
|---|---|---|---|
| 1,983,617 | 12/1934 | Ladon | 160/123 X |
| 2,065,402 | 12/1936 | Schweller | 160/DIG. 7 |
| 3,296,023 | 1/1967 | Leaderman et al. | 428/241 |
| 3,775,226 | 11/1973 | Windorf | 428/458 |
| 3,867,244 | 2/1975 | Adams | 428/182 |
| 4,079,772 | 3/1978 | Klaenhammer et al. | 160/268 |
| 4,317,481 | 3/1982 | Oswald | 160/DIG. 7 |

*Primary Examiner*—Peter M. Caun

*Attorney, Agent, or Firm*—Seed, Berry, Vernon & Baynham

[57] ABSTRACT

A five-layer window shade fabric 100 especially useful in forming a Roman shade which will substantially increase the insulating factor (R) for a glass window-pane has a moisture-, light-, and mildew-resistant exterior layer 10; an insulation layer 12 adjacent the exterior layer; a vapor barrier 14 adjacent the insulation layer to reduce condensation and to trap a layer of air between the barrier and the window; a reflective sheet adjacent the barrier to reflect heat back into the room; and an interior cover fabric 18 adjacent the reflective sheet and chosen to complement the room decor.

16 Claims, 7 Drawing Figures

FIG. 1
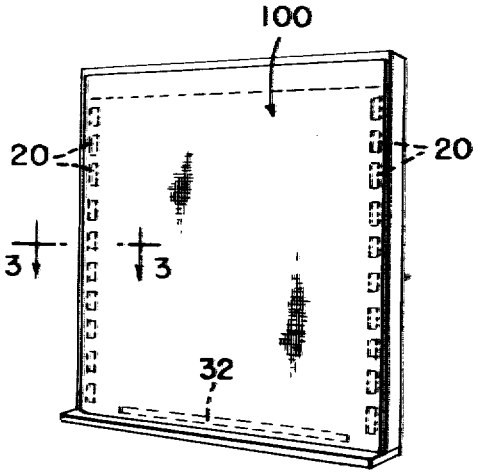
FIG. 2
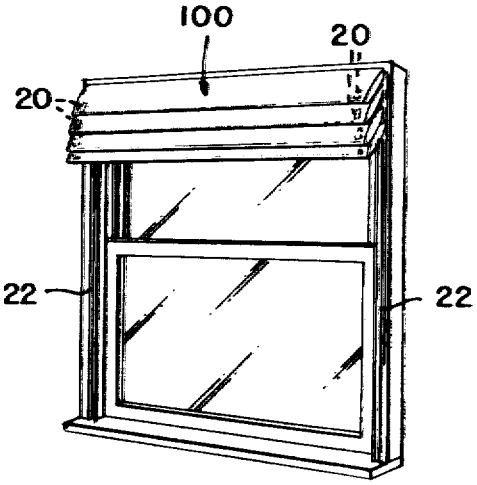
FIG. 3
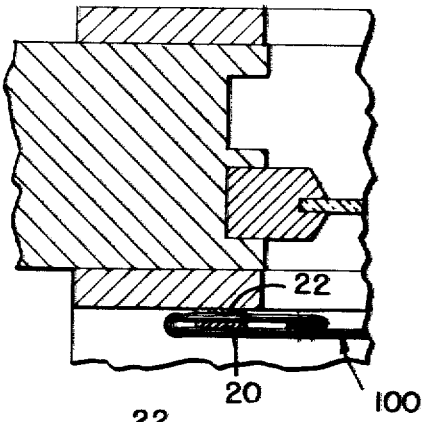
FIG. 5
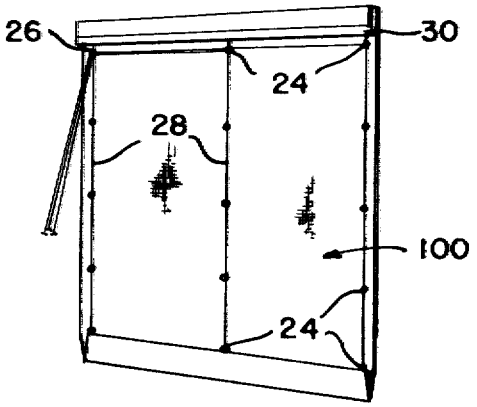
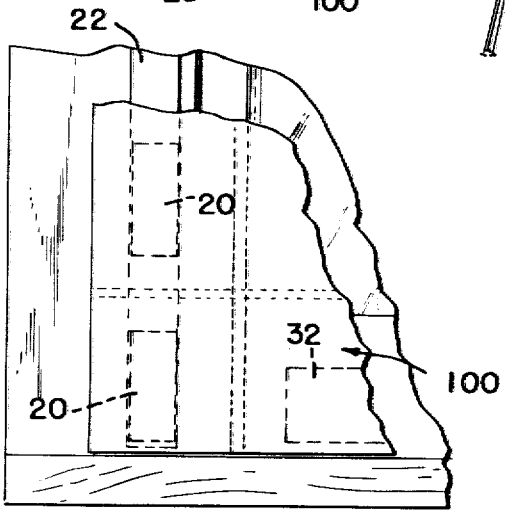
FIG. 4

INSULATED WINDOW SHADE

TECHNICAL FIELD

This invention relates to a novel fabric for making an insulated window shade which, when used in a Roman shade in a single-glazed, wood frame, double-hung sash window with a three-inch (7.6 cm) air space between the shade and the glass, provides an insulting factor (R) of about 7.69. The five layer fabric has a moisture-, light-, and mildew-resistant exterior layer that fronts the pane of glass; an insulating layer adjacent the exterior layer, preferably made from a polyester, needle-punched, quilted insulation layer; a polyethylene-film vapor barrier adjacent the insulation layer; a foil-faced, reflective liner adjacent the vapor barrier; and an interior cover fabric adjacent the liner.

BACKGROUND ART

With the increase in cost of fossil fuels, many developments have been made to reduce window heat loss. A particularly useful resource book covering the subject is "MOVABLE INSULATION—A Guide to Reducing Heating and Cooling Losses Through the Windows in Your Home," by William K. Langdon, Rodale Press, 1980. A second resource is "THERMAL SHUTTERS AND SHADES—Over 100 Schemes for Reducing Heat-Loss Through Windows," by William A. Shurcliff, Brick House Publishing Co., Inc., 1980.

A wide variety of movable insulation is disclosed in these books. The various shades have differing insulating effects and differing costs. The fabric of this invention provides a relatively low-cost means of greatly increasing the insulative factor for a home window. For comparison, a single-pane window tested by Architectural Testing, Inc., of York, Pa., in accordance with standards published in ASTM C-236 has an R factor of approximately 1.30. Adouble-pane insulated window with a ⅜-inch (0.95 cm) air space has an R factor of about 1.83. Windows having outside storm windows have an R factor of approximately 2.20. A window insulated with rolling shades constructed with the fabric of this invention has an insulating factor of about 7.69. Thus the insulated fabric of this invention is more effective than additional glazing and is less expensive, especially for retrofitting.

DISCLOSURE OF INVENTION

The most basic commercial commodity using principles of this invention is a four-layer insulating fabric which has a (1) moisture-, light-, and mildew-resistant exterior layer which fronts the pane of glass, (2) an insulation layer which is adjacent the exterior layer and which is preferably a needle-punched polyester quilting material, (3) a vapor barrier (preferably of polyethylene or vinyl) adjacent the insulation layer to reduce condensation and to trap a layer of air between the vapor barrier and the window glass, and (4) a reflective sheet (preferably a foil-faced reflective liner) which is adjacent the vapor barrier. When installed in a home to provide an insulated window shade, a decorative interior cover layer is placed adjacent the reflective sheet. In this manner, the window shade becomes an attractive feature for the home. Preferably, the moisture-, mildew-, and light-resistant exterior layer is an insulated drapery lining such as described in U.S. Pat. No. 3,296,023.

To produce an insulated window having an insulating factor (R) of about 7.69 for a single-glazed, wood frame, double-hung sash window having a three-inch (7.62 cm) air space between the shade and window glazing, the window shade should be sealed on the top and sides and should rest upon the windowsill at the bottom. Suitable side seals are formed by sewing 3½-inch (8.89 cm) strips of magnetic tape into the side seams of the window fabric between the decorative cover and the foil-faced reflective liner. Strips of magnetic tape are also placed along the side sashes of the window. Alternatively, a ferromagnetic strip, which is attracted by the 3½-inch (8.89 cm) strips of magnetic tape in the window shade, may also be placed on the sash. A weight is preferably fashioned into the bottom seam of the window to aid raising and lowering of the shade and to ensure that the shade seals snugly when it rests on the windowsill. A wooden mounting bar to which the window fabric is attached, has fabric along one face, over the top edge, and down a portion of the second face. The mounting bar is attached to the wall above the window to provide a substantial air seal at the top of the shade. No air gap is left at the top which may act as a thermal siphon.

BRIEF DESCRIPTION OF THE DRAWINGS

FIG. 1 is a perspective view of a typical window showing a drawn window shade.

FIG. 2 is a perspective view showing a raised window shade.

FIG. 3 is a cross-section through one sash upright, taken along line 3—3 of FIG. 1.

FIG. 4 is an partial exploded view of the bottom of the window shade of FIG. 1.

FIG. 5 is a view showing the mounting board and means to raise and to lower the shade.

BEST MODE FOR CARRYING OUT THE INVENTION

1. Introduction

Figure 6:
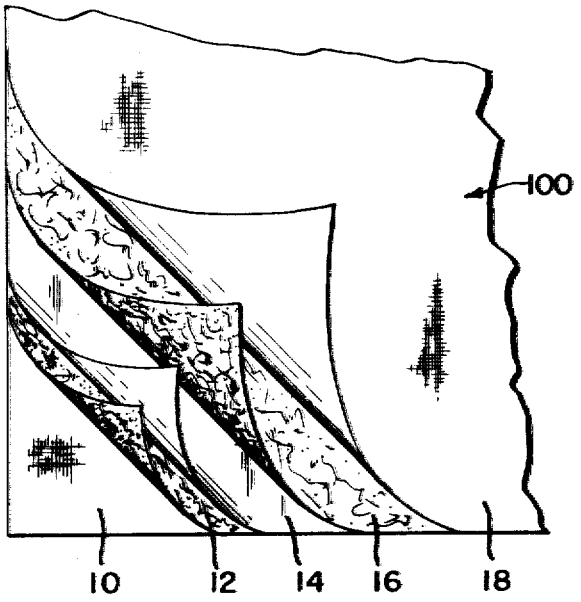
FIG. 6 is a detailed view of the five layers of a preferred fabric of this invention.
Figure 7:
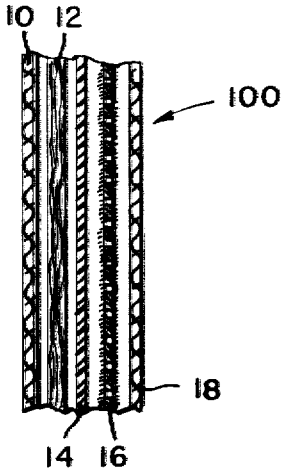
FIG. 7 is a partial cross-section of the fabric of this invention.

The insulating window shades of this invention are constructed of a five-layer fabric which, if used in a Roman window shade with magnetic strip seals on the sashes, can reduce window heat loss by about eighty-three percent. The layer of the fabric exposed to the interior of the dwelling is selected by the user, while the remaining four layers of fabric form the basic insulating window shades of this invention. The five layers of the insulating fabric used will be described first, followed by a description of other useful materials that are needed to construct an insulating window shade with an increased insulating capacity. After outlining the materials that are necessary for constructing a window shade, a short discussion will proceed with various mountings for different types of windows. Then, a detailed description of the method for installing a Roman window shade will be given. Finally, a short summary of the value of the insulating window shades of this invention will be presented.

2. The Insulating Fabric

The insulating window shade 100, which can reduce window heat loss by up to eighty-three percent, consists of five layers. The first layer 10 is a moisture-, light-, and mildew-resistant exterior fabric layer of thermal suede. The second layer 12 is a high-density, needle-punched, polyester quilted fabric which creates a maximum number of dead air spaces to provide the maximum insulating factor relative to thickness and weight. The third layer 14 is a vapor barrier which reduces or prevents condensation on the window and traps a layer of air between the vapor barrier and the window glass. The fourth layer 16 is a reflective layer to reflect heat back into the room. Preferably, this reflective layer is needle-punched with polyester fiber to create more dead air spaces and to provide additional insulation. The fifth layer 18, which forms the interior surface of the shade, is left to the personal choice of the user.

A. The Exterior Fabric Layer

A preferred first layer 10 is an insulated drapery lining of thermal suede essentially as described in U.S. Pat. No. 3,296,023, which is incorporated by reference into this specification. This first layer faces the pane of glass and must be moisture-, light-, and mildew-resistant. The insulated drapery lining of U.S. Pat. No. 3,296,023 functions admirably in this role and provides sufficient stiffness and strength for the shade to support the multiple layers that are necessary in the insulated window shade of this invention. Those skilled in the art will recognize other types of insulated drapery linings which will serve the function described.

B. The Insulation Layer

To provide the maximum insulating factor, it is important that air be trapped in small air spaces. Thus the second layer 12 of the insulating window shade of this invention should be a lightweight fiber which creates multiple small air spaces. A preferred fiber is high-density, needle-punched, polyester fiberfill, such as the product sold under the trademark "Dacron II" by E. I. duPont deNemours Co., Inc. There are also other suitable insulation materials which can be used. The insulation layer should be lightweight, flexible, and capable of creating dead air spaces. The quilted polyester which is preferred possesses all of these characteristics and is a readily available fabric layer. Other suitable layers are described in the book "MOVABLE INSULATION—A Guide to Reducing Heating and Cooling Losses Through the Windows of Your Home," by William K. Langdon, Rodale Press, 1980.

C. The Vapor Barrier Layer

To reduce condensation on the window and to trap a layer of air between the vapor barrier and the window, the third layer 14 preferably consists of an impervious film of polyethylene or vinyl. Ordinarily, a one-mil thick film of polyethylene will be satisfactory or a two- to three-mil thick film of vinyl. Polyethylene is preferred because of its reduced cost and improved availability. Vinyl, while a better vapor barrier, has the disadvantages of being less commonly available and being more costly. Other plastic films may be used. The vapor barrier acts as a separate glazing for the window and creates a dead air space much the same as the air space between double- and triple-glazed windowpanes. Those skilled in the art will recognize reasonable substitutes for the preferred one-mil thick film of polyethylene.

D. The Reflective Layer

Often, radiant heat escapes through a window because it passes through the glass unimpaired. Therefore, it is important that a window shade include a fourth layer 16 which is a reflective sheet to reflect the radiant heat back into the room. Numerous suitable reflective sheets are commercially available. Many are foil-faced reflective liners, such as those products sold under the trademarks "Mylar," "Foylon," "Astrolon," and "Dura-Shade." Preferably, the reflective sheet is needle-punched with polyester fiber to provide both reflective and insulative properties to this layer. "Mylar" is an aluminized plastic sold by the E. I. duPont deNemours Company, Inc. "Foylon," also called "Fabrifoil Aluminum," is a coated polyester fabric or vinyl sheet sold by the Duracote Corporation. "Astrolon," also called "Space Blanket," is a vacuum-deposited aluminum film between polyethylene films sold by the King-Seeley Thermos Company. "Dura-Shade" is a thin vinyl sheet with aluminum foil on one side sold by the Duracote Corporation. While the term "Mylar" is often used to refer to a plastic film alone, in this specification, "Mylar" refers to a vacuum-deposited, aluminum-coated film of plastic. A suitable "Mylar" is sold under the name "Emergency Blanket" by King-Seeley Thermos Company.

E. The Interior Fabric Layer

The cover fabric 12 of the insulating window shade 100 of this invention is generally a decorative fabric which is chosen by the user to complement the room decor. Highly textured or pile fabrics, loosely woven fabrics, or stretchy fabrics should be avoided for this decorative interior layer. To allow suitable seams, the cover fabric should be three inches (7.62 cm) wider and twelve inches (30.5 cm) longer than the finished shade measurement. Most other cotton or synthetic fibers will be satisfactory for this interior layer.

To form the insulating window fabric which is suitable for use in this invention, the five layers are sandwiched together with the exterior layer adjacent the windowpane, the insulating layer adjacent the exterior layer, the vapor barrier as the third and middle layer, the reflective layer above the vapor barrier, and the interior decorative layer on the top.

3. Other Useful Materials

In constructing a Roman shade which has a high insulating factor (R) of about 7.69, it is important that the sides be sealed to drafts and that the top also be sealed to prevent a thermal siphon action. Many accoutrements are desirable to prepare this shade, such as magnetic tape 20 and 22 for airtight sealing of the edges of the shade, cord 28 for easy raising and lowering of the shade, a weight bar 32 to hold the bottom of the shade against the windowsill, rings 24 to order the raising and lowering, a mounting bar 30, screws, and other hardware.

A. The Magnetic Tape

Strips of adhesive-backed magnetic tape 20 and 22 are commercially available today. This tape may be easily cut into small sections and adhered between layers of the insulating fabric. A second magnetic strip is adhered to the window frame at each side. The magnetic strip along the edges of the window shade and the strips on the window frame attract one another to achieve a relatively airtight edge seal for the window shade. Using magnetic strip in the window fabric itself is preferred because of the light weight and the flexibility of the commercially available adhesive-backed magnetic tape. A ferromagnetic material, such as any steel product, may be substituted for the magnetic tape which is adhered to the window frame.

B. A Weight Bar

To weight the bottom of the shade for smooth operation and to help provide an airtight seal at the bottom of the shade when it rests on the sill, a ⅜-inch (0.95 cm) steel rod is preferably sewn into a hem at the bottom of the shade to serve as a weight bar 32. Before installation, the steel rod should be rust-proofed. Various other weighting materials may be used, such as sand, but the steel weight bar 32 is preferred because of its simplicity.

C. The Mounting Bar

The mounting bar 30 helps to seal the top edge of the window shade and reduces thermal siphon action which might otherwise occur. Preferably, the mounting bar is a one-inch by two-inch (2.54–5.1 cm) wooden board properly sized for the window. Ordinarily, the top of the window shade fabric is stapled to one face of the one-by-two mounting bar and the fabric extends upward on that face over the top and down the opposite face. The mounting bar is then adhered to the wall or window frame to form a solid wooden seal for the top of the window shade.

Having discussed the desirable materials incorporated into an insulating window shade of this invention, this specification will now discuss how to install a window shade to obtain the desired insulating effect.

4. Window Mountings

Three basic types of mounting are available: the outside mount, the inside mount, and the hybrid mount.

A. The Outside Mount

To mount an insulating window shade over sliding glass doors, for example, the mounting bar and shade are mounted on the wall of the window. If the Roman shade design is used, the mounting board should be high enough that all folds of the raised Roman shade are stored above the window. Then, light and visibility will be not be obstructed. In this method, the mounting bar is affixed directly to the wall and not to a part of the window frame. The window shade is wider than the window in which it is used.

B. The Inside Mount

The inside mount attaches to the inside of the window frame. This mounting method requires greater accuracy in fitting the shade and may require additional molding for applying the magnetic tape which forms the edge seal. The mounting board fits between the window sashes.

C. The Hybrid Mount

In the hybrid mount, the mounting bar fits inside the window frame and the insulating fabric overlaps the window frame a minimum of about three-quarters inch (1.9 cm) on either side to cover the magnetic tape. The hybrid mount technique is illustrated in FIGS. 1, 2, and 3.

D. Sizing the Shade

For the inside mount, it is important that the shade fits snugly within the window casing; therefore, the mounting bar should be equal in length to the width of the window measured between the casing. The window shade should be at least as long as the length of the window measured from the inside edge of the top to the windowsill. For the outside or hybrid mount, it is important to measure the width of the insulating window shade to be approximately equal to or greater than the width of the window casing from its outside edges. The outside mount uses a mounting bar approximately equal in length to the window fabric shade length. The hybrid mount uses a mounting bar which will fit within the inside casing of the window. The length of the shade should be adequate so that the weight bar will rest upon the top of the sill.

5. Installation of Roman Shades

The four-layer insulating fabric which forms the base of the insulating window shades 100 of this invention should be as wide as the width of the desired shade, and should be as long as the finished shade with four additional inches (10.15 cm) for mounting. The cover fabric 18 which forms the interior layer should be about three inches (7.62 cm) wider than the desired width of the shade to allow a 1½-inch (3.81 cm) wrap around each side for hemming purposes. The length of the cover fabric should be the finished length of the shade plus about twelve inches (30.5 cm) (eight inches (20.3 cm) for a hem at the bottom and four inches (10.15 cm) for mounting at the top).

To prepare the five-layer fabric which will constitute the insulating window shade, the right side of the cover fabric and the exterior layer of the four-layer window fabric are placed together. The top and side edges are matched, noting that the cover fabric will not lie smoothly. A seam is stitched approximately one-half inch (1.25 cm) from the edge of the shade. A second row of stitching close to the edge, catching all the layers, will ensure that the shade is secure.

Three and one-half-inch (8.89 cm) length strips of magnetic tape 20 are adhered to the wrong side of the cover fabric in spaced relation to one another along the edge in the seam area. The corners of the magnetic strips should be smoothed to avoid sharp edges. Quilting rows should be sewn across the entire fabric of the four insulating layers with approximately eight-inch (20.3 cm) spacing. These quilting rows will help one to orient the 3½-inch (8.89 cm) long strips of magnetic tape. After adhering the magnetic strips to the wrong side of the cover fabric, the shade is turned right side out and spread smooth.

The cover fabric has an eight-inch (20.3 cm) allowance at the bottom for a hem. This allowance should be turned up four inches (10.15 cm) and sewn to form a first hem. Thereafter, another row, one inch (2.54 cm) below the first hemline, should be sewn to form a pocket for the weight bar.

To allow easy raising and lowering of the Roman shade, every quilting line should have evenly spaced rows of rings 24 approximately eight to twelve inches (20.3–30.5 cm) apart. The outside row of rings should start 1½ inches (3.81 cm) from the edge of the window shade, making sure that the rings clear the window frame and magnetic tape when the insulating fabric is installed. The four-inch (10.15 cm) allowance at the top of the fabric is lined up with the proper length of mounting bar. Screw eyes are mounted in line with the vertical rows of rings to allow the cord 28 to be pulled. A pulley 26 should be used in place of a screw eye **24*a* at the operating end of the shade, where the cord 28 will extend from the side and be pulled. The fabric is fastened to the mounting bar 30** by stapling along one face so that the fabric extends upwardly on the face over the top edge and hangs downwardly along the other face of the mounting bar.

A cord 28 is tied to each bottom ring with a square knot and a few drops of white glue or other glue are used to ensure that the knot is secure. The cords run through all of the rings 24 in their respective rows and through the screw eye over to the pulley. As shown in FIG. 5, three cords extend together toward the left side of the figure. The cord ends should be cut to the same length and the ends should be tied together so that all the cords will operate simultaneously when pulled by the operator.

Long screws are used to attach the mounting board 30 to the wall, ceiling, or inside of the window, as desired. A cleat may be mounted on the operating side of the window to secure the cords when the shade is raised. Finally, a magnetic tape strip or a ferromagnetic strip 22 is mounted on the frame or wall to overlap the magnetic strips of the window shade edges.

To raise the shade, the magnetic seals on the edges of shade are released by pulling the shade out at the bottom. A pull tab is helpful to protect the lower edge of the shade. Once released from the magnetic seal, the cords are drawn to raise the shade in loose folds along the quilting lines. As usage continues, the folds will pleat more easily than with a newly installed shade. A useful resource with more information about making Roman shades is "THE SHADE BOOK," by Judy Lindahl.

6. Test Results for a Preferred Roman Shade

A properly constructed and installed Roman shade was tested by Architectural Testing, Inc., of York, Pa., in accordance with standards in ASTM C-236. During the test conditions, the interior temperature of the room was approximately 68° F. (20° C.). The exterior temperature was approximately 18° F. (−8° C.). The outside wind velocity was approximately fifteen miles per hour. The Roman shade was installed over a wood frame, double-hung sash window having single glazing. A three-inch (7.62 cm) air space was provided between the glazing and the shade. The insulating factor (R), that is, the resistance to heat flow, was measured to be about 7.69 for this window shade. Thus, a simple and inexpensive means is available to increase greatly the insulative capacity of a window. Up to about an eighty-three percent improvement can be made in window heat loss. Although the insulating factor of 7.69 will not be achievable in all conditions, it is obvious that a substantial improvement is available with the simple shade of this invention. An insulating factor (R) of at least about 7.00 or 7.50 should be easily obtainable.

We claim:

1. A five-layer window shade fabric forming the hanging for an insulating window shade to improve the insulation of a pane of glass in a window of a building, comprising:

(a) a moisture-, light- and mildew-resistant exterior fabric to front the pane of glass;

(b) an integral insulation layer of lightweight, needle-punched fiber insulation adjacent the exterior layer;

(c) a vapor barrier adjacent the insulation layer to reduce condensation on the glass and to trap a layer of air between the barrier and the window, the barrier being selected from the group of films consisting of films of polyethylene and vinyl;

(d) a reflective sheet of aluminized polymer adjacent the barrier; and (e) an interior cover fabric adjacent the reflective sheet.

2. The window shade fabric of claim 1 wherein the reflective sheet is needle-punched with fiber insulation to provide additional spaces for trapping air, thereby improving the insulative properties of the window shade fabric.

3. The window shade fabric of claim 1 wherein the vapor barrier is a film of polyethylene having a thickness of at least about one mil.

4. The window shade fabric of claim 1 wherein the vapor barrier is a thick film of vinyl having a thickness of at least about two mils.

5. A five-layer window shade fabric forming the hanging for an insulating window shade to improve the insulation of a pane of glass in a window of a building, consisting essentially of:

(a) a moisture-, light- and mildew-resistant exterior layer to front the pane of glass;

(b) a polyester, fibrous quilting insulation layer adjacent the exterior layer;

(c) a polyethylene film vapor barrier adjacent the insulation layer to reduce condensation on the glass and to trap a layer of air between the barrier and the window;

(d) a aluminized polymeric reflective liner adjacent the barrier; and (e) an interior cover fabric adjacent the reflective sheet.

6. The window shade fabric of claim 5 wherein the reflective sheet is needle-punched with fiber insulation to provide additional spaces for trapping air, thereby improving the insulative properties of the window shade fabric.

7. An insulating fabric suitable for use in an insulating window shade to improve the insulation of a pane of glass in a window of a building, comprising:

(a) a moisture-, light- and mildew-resistant exterior layer to front the pane of glass;

(b) an insulation layer of lightweight, needle-punched fiber insulation adjacent the insulation layer to reduce condensation on the glass and to trap a layer of air between the barrier and the window; and (c) a polymeric film vapor barrier adjacent the insulation layer to reduce condensation on the glass and to trap a layer of air between the barrier and the window; and (d) a reflective sheet of aluminized polymer adjacent the barrier, wherein a decorative fabric cover is attachable to the face of the reflective sheet to form a complete window shade fabric suitable for hanging in a window.

8. The fabric of claim 7 wherein the reflective sheet is needle-punched with a fiber insulation to provide additional spaces for trapping air.

9. The fabric of claim 7 wherein the vapor barrier is selected from the group of films consisting of films of polyethylene and vinyl.

10. An insulating window shade to increase the insulating factor (R) for panes of glass in a window, comprising:

(a) a window shade fabric having a top, a bottom, and two side edges, and comprising:

(i) a moisture-, light- and mildew-resistant exterior layer to front the pane of glass;

(ii) an insulation layer of lightweight, needle-punched fiber insulation adjacent the exterior layer;

(iii) a polymer film vapor barrier adjacent the insulation layer;

(iv) a reflective sheet of aluminized polymer adjacent the vapor barrier; and (v) an interior cover fabric adjacent the reflective sheet;

(b) two magnetic strips spaced along the edges of the window shade fabric capable of substantially sealing the edges of the shade by adhering to a strip on the casing of the window;

(c) a weight fabricated into the bottom of the window shade fabric to hang the shade taut, to smooth raising and lowering of the shade, and to help provide a seal for the bottom of the shade; and (d) a mounting bar to which the top of the window shade fabric is attached to provide a substantial air seal at the top of the shade.

11. The shade of claim 10 wherein each magnetic strip comprises a plurality of sections of magnetic tape.

12. The shade of claim 10 wherein the top of the fabric contacts at least three sides of the mounting bar in its attachment and wherein the mounting bar has a flat face which is attached to the building in forming the air seal.

13. An insulating window shade to increase the insulating factor (R) for panes of glass in a window, comprising:

(a) a window shade fabric having a top, a bottom, and two side edges, and comprising:

(i) a moisture-, light- and mildew-resistant exterior layer to front the pane of glass;

(ii) an insulation layer of lightweight, needle-punched fiber insulation adjacent the exterior layer;

(iii) a polymer film vapor barrier adjacent the insulation layer;

(iv) a reflective sheet of aluminized polymer adjacent the vapor barrier; and (v) an interior cover fabric adjacent the reflective sheet;

(b) two ferromagnetic strips spaced along the edges of the window shade fabric, capable of substantially sealing the edges of the shade by adhering to a strip on the casing of the window;

(c) a weight fabricated into the bottom of the window shade fabric to hang the shade taut, to smooth raising and lowering of the shade, and to help provide a seal for the bottom of the shade; and (d) a mounting bar to which the top of the window shade fabric is attached to provide a substantial air seal at the top of the shade.

14. The shade of claim 13 further comprising magnetic sealing means fabricated into the bottom of the shade to provide a substantial air seal at the bottom.

15. The shade of claim 13 wherein the shade provides an insulating factor (R) of at least about 7.00 when tested in a single-glazed, wood frame, double-hung sash window with a three-inch (7.62 cm) air space.

16. An insulating window shade to increase the insulating factor (R) to about 7.69 for a single-glazed, wood frame, double-hung sash window with a three-inch (7.62 cm) air space, comprising:

(a) a window shade fabric having a top, a bottom, and two side edges:

(i) a moisture-, light- and mildew-resistant insulated drapery lining to front the pane of glass;

(ii) a needle-punched, fibrous polyester quilting insulation layer adjacent the exterior layer;

(iii) a polyethylene film vapor barrier adjacent the insulation layer to reduce condensation on the glass and to trap a layer of air between the barrier and the window;

(iv) a reflective liner of aluminized polymer adjacent the vapor barrier, including fiber insulation needle-punched through the liner; and (v) an interior cover fabric adjacent the liner;

(b) two magnetic strips formed from segments of magnetic tape spaced along the side edges of the window shade fabric, capable of substantially sealing the edges of the shade by adhering to a strip on the casing of the window;

(c) a weight fabricated into the bottom of the window shade fabric to hang the shade taut, to smooth raising and lowering of the shade, and to help provide a seal for the bottom of the shade;

(d) a rectangular mounting bar to which the top of the window shade fabric is attached to one face (the fabric passing over one side and down an opposed face) to provide a substantial air seal at the top of the shade when the bar is affixed to the window casing; and (e) means for drawing the shade in the manner of a Roman shade.

* * * * *